US008771467B2

(12) United States Patent
Fang

(10) Patent No.: US 8,771,467 B2
(45) Date of Patent: Jul. 8, 2014

(54) CARRIER TAPE BASE PAPER MAKING METHOD AND BASE PAPER MADE THEREBY

(75) Inventor: Junyun Fang, Zhejiang (CN)

(73) Assignee: Zhejiang Jiemei Electronic & Technology Co., Ltd, Zhejiang (CN)

( * ) Notice: Subject to any disclaimer, the term of this patent is extended or adjusted under 35 U.S.C. 154(b) by 0 days.

(21) Appl. No.: 14/115,624

(22) PCT Filed: Mar. 12, 2012

(86) PCT No.: PCT/CN2012/072203

§ 371 (c)(1), (2), (4) Date: Nov. 29, 2013

(87) PCT Pub. No.: WO2013/134911

PCT Pub. Date: Sep. 19, 2013

(65) Prior Publication Data

US 2014/0076509 A1 Mar. 20, 2014

(51) Int. Cl.
*D21H 27/30* (2006.01)
*D21H 27/00* (2006.01)

(52) U.S. Cl.
CPC ..... *D21H 27/30* (2013.01); *D21H 27/00* (2013.01)
USPC ..... 162/129; 162/149; 162/164.6; 162/168.3; 162/172; 162/175; 162/205; 162/206; 162/181.1; 162/118

(58) Field of Classification Search
CPC ..... D21H 27/00; D21H 27/30; D21H 17/17; D21H 17/28; D21H 17/31; D21H 17/37; D21H 17/53; D21H 17/55; D21H 17/57; D21H 11/04; D21H 21/16; D21H 21/20; D21H 21/22; B32B 29/00; B32B 33/00
USPC ..... 162/109, 118, 123, 125–129, 135, 141, 162/149, 158, 164.1, 164.6, 168.1–168.3, 162/172, 175, 17, 178, 181.1, 204–207; 428/172, 195.1
See application file for complete search history.

(56) References Cited

U.S. PATENT DOCUMENTS

2014/0076509 A1* 3/2014 Fang ..... 162/129

FOREIGN PATENT DOCUMENTS

| | | | |
|---|---|---|---|
| CN | 1579756 | A | 2/2005 |
| CN | 101100830 | A | 1/2008 |
| CN | 102587220 | A | 7/2012 |
| CN | 102587221 | A | 7/2012 |
| JP | 2008-1378 | A | 1/2008 |
| JP | 2008-133019 | A | 6/2008 |

OTHER PUBLICATIONS

Chinese Patent Office Examination Report dated Dec. 27, 2012.

* cited by examiner

*Primary Examiner* — Jose Fortuna
(74) *Attorney, Agent, or Firm* — NK Patent Law, PLLC

(57) ABSTRACT

A carrier-tape base paper making method and the base paper made thereby fall into the technical field of papermaking. According to performance requirements, the base paper is made through pulp conditioning and papermaking, in which different pulping and auxiliary materials for surface, intermediate and bottom layers are added. The method includes such steps as beating, conditioning, papermaking, calendering and reeling. The carrier-tape base paper features high strength, perfect waterproof and bonding performance, limited physical damages to electronic elements and satisfactory resilience.

10 Claims, No Drawings

CARRIER TAPE BASE PAPER MAKING METHOD AND BASE PAPER MADE THEREBY

CROSS-REFERENCE TO RELATED APPLICATION

This application is a United States national stage entry of PCT application No. PCT/CN2012/072203, titled "A CARRIER-TAPE BASE PAPER MAKING METHOD AND BASE PAPER MADE THEREBY," filed on Mar. 12, 2012, which is incorporated herein in its entirety by this reference.

TECHNICAL FIELD

The present invention is related to a carrier-tape base paper making method and the base paper made thereby.

BACKGROUND OF THE INVENTION

The development and extensive application of electronic elements have become one of the important symbols for the development of electronic industry of a nation. Presently, various electronic elements, including passive, electromechanical, acoustic and composite elements, are in a trend to complication, precision and miniaturization. On this account, carrier-tape used for packing, transportation and acquisition of electronic elements is of vital importance to the protection of electronic elements. Existing carrier-tape can be divided into plastic carrier-tape and base paper carrier-tape by material. As it is difficult to ensure the dimensional precision of plastic carrier-tape, and to eliminate the chamfer in case of punching; moreover, plastic material is unavailable for buffer, which may incur mechanical damages to electronic elements, plastic carrier-tape has been gradually replaced by base paper carrier-tape featuring in high resilience, easy production and low cost. However, strength of the base paper is inferior to that of the plastics, which may produce dust to the extent of affecting the performance of electronic elements and incurring blockage to relevant components. Moreover, chemical composition of the base paper may also affect the quality of electronic elements, etc.

In view of the fact that chemical composition of the base paper may affect the quality of electronic elements, Patent CN1579756A renders a carrier-tape material that can prevent corrosion to installations on the surface thereof. Such material is in multilayer papermaking structure composed of various pulpwood, which aims to control the residual sulfate ion content below 500 ppm through adjustment of surface pH value to 6.0~8.0. Meanwhile, 1.0~8.0 and 0.1~1.0 parts of paper strength agent and tackifier respectively are added to 100 parts of multilayer pulpwood by weight, aiming to adjust the moisture of wet paper to be extruded to 75~80%.

Patent CN1593910A discloses a carrier-tape material that can link up the covered tape via thermal sealing to prevent unexpected peeling without causing damages to the paper when the covered tape is stripped. According to the technical solution, liquid containing 90:10~50:50 water-soluble polymer and styrene acrylic resin (melting point: 80~120° C.) is coated on the surface and/or backface of the carrier-tape made of material containing pulp fiber.

Patent CN1629401A renders a carrier-tape base paper featuring limited thickness variation and zero deviation to operation efficiency; its technical solution is stated as follows: The base paper is to be made into multilayer acid paper with rosin filler added to the intermediate layer; alternatively, it can also be made into multilayer neutral copy paper with alkyl ketene dimer filler added to the intermediate layer; the mass fraction of the filler corresponding to 100 mass fractions of fully dried pulp is 0.1~50.75.

Aforesaid patents are expected to change the mass of the base paper by changing material composition, which are unlikely to cater to such performances simultaneously as smoothness and high strength of the surface, perfect flexibility and limited physical damages of the intermediate part, and high resilience of the backface; these preferences are important to the normal operation of the carrier-tape and the quality of electronic elements.

SUMMARY OF INVENTION

The present invention aims to provide a simple making method of carrier-tape base paper that can significantly improve the quality thereof and a high-quality base paper made thereby featuring high strength, perfect waterproof and bonding performance, limited physical damages to electronic elements and high resilience.

Aforesaid technical purpose of the present invention is realized by the following technical solution: a carrier-tape base paper making method composed of papermaking of a surface layer, an intermediate layer and a bottom layer, which comprises the following steps:

(1) Beating: Pulping materials are to be mixed and broken into surface, intermediate and bottom pulps prior to beating to the degree of 42~45$^{degrees\ SR}$, 48~50$^{degrees\ SR}$ and 38~40$^{degrees\ SR}$ respectively;

(2) Pulp conditioning: Adjust the concentration of well-beaten pulp to 0.65~0.85%, and add various auxiliary materials; wherein, weight of paper waterproof agent, paper strength agent and bonding agent added into the pulping materials for surface layer account for 1-3%, 3-5% and 0.3-0.6% of the total respectively; weight of softening agent and thermal-fusion bonding agent added into the pulping materials for intermediate layer account for 0.5-1.5% and 1-3% of the total respectively; weight of crosslinking agent and bonding agent added into the pulping materials for bottom layer account for 0.5-1% of the total respectively; after that, adjust the pH to 6.5~7.5 and stir the mixture evenly, then place it at 25~30° C. for 20-30 min to obtain the papermaking materials for the surface, intermediate and bottom layers; finally, proceed with screening, purification and deslagging prior to degassing.

(3) Papermaking: Proceed with wire forming with multilayer papermaking method to obtain one or more surface, intermediate and bottom layers; after that, proceed with bonding of wet paper in a sequence of surface-intermediate-bottom layers prior to pressing and drying with conventional method.

(4) Calendering and reeling are done with and conventional method.

The surface pulping material in Step (1) comprises 45-65% sulfate softwood pulp and 35-55% sulfate hardwood pulp by weight; the intermediate pulping material comprises 30-50% sulfate softwood pulp and 55-75% sulfate hardwood pulp by weight; whereas the bottom pulping material comprises 20-40% sulfate softwood pulp and 65-80% sulfate hardwood pulp by weight.

The carrier-tape base paper made with the aforesaid method, comprises a rated 105-125 g/m$^2$ surface layer, a 200-500 g/m$^2$ intermediate layer and a 165-185 g/m$^2$ bottom layer; according to the performance requirements of each layer, different paper pulp raw materials are employed for the surface layer, intermediate layer and bottom layer, and different auxiliary materials are added for conditioning the pulp and making the paper; the tensile strength, surface strength expressed in critical wax strength grade and water resistance of the surface layer is 6.5-8.5 kN/m, 16 A~18 A and not less than 600 s respectively; the softness of the intermediate layer is 100-150 mN; paper powder generation measured by experimental method of taper friction loss is below 100 ppm; the stiffness of the bottom layer is 25-40 mN; and the interlayer bonding force measured with a Scott internal bonding strength tester is not less than 150 J/m$^2$.

Pulp is the main factor affecting paper strength. Generally, the longer the fiber, the higher the strength is. For this reason, softwood is superior to hardwood and sulfate pulp is superior to sulfite pulp in terms of strength. Therefore, sulfate softwood pulp with high content of long fiber is selected as the surface pulp material to obtain higher strength. Normally, paper made of long fiber features good strength and folding endurance; whereas that made of short fiber provides bulk, resilience and appearance. As the bottom layer of carrier-tape base paper requires better resilience to ensure the high-speed operation thereof, pulping material with higher contents of short fiber and sulfate hardwood pulp is selected. Despite the fact that higher content of long fiber can produce better paper strength and folding endurance, and higher content of short fiber can bring better paper resilience and bulk, the contents of sulfate softwood pulp and sulfate hardwood pulp of pulpwood are recommended respectively as follows: 45-65% and 35-55% for the surface layer, 30-50% and 55-75% for the intermediate layer, and 20-40% and 65-80% for the bottom layer, taking into account the actual needs and costs of base paper.

Extremely low beating degree and poor bonding force of fiber may result in low physical strength of paper; whereas extremely high beating degree may result in prolonged beating time and high fiber cutting; for this reason and considering the pulping materials for surface, intermediate and bottom layers of the present invention, it is recommended to beat the surface, intermediate and bottom pulping materials to the degree of 42~45 degrees SR, 48~50 degrees SR and 38~40 degrees SR respectively; furthermore, control over the beating degree of each layer also helps to enhance interlayer bonding force.

In addition, paper strength agent, waterproof agent and bonding agent shall be added to the pulp for surface layer to obtain a tensile strength of 6.5~8.5 kN/m, a surface strength of 16~18 A expressed in critical wax strength grade and a water resistance of not less than 600 s.

In a preferred embodiment of the present invention, polyacrylamide, sodium polyacrylate, chitin and polyaminoamide can be used as the paper strength agent individually or together; wherein, polyacrylamide including anionic, cationic and amphiprotic polyacrylamide can be used as the paper strength agent for the present invention. The paper strength agent used herein can partially prevent bur and dust in addition to the enhancement of surface strength. The quantity thereof should be equivalent to 3-5% of the total quantity of the surface pulping materials; addition below 3% will result in low surface strength obviously; whereas that over 5% contributes little to the enhancement of surface strength, and may even contaminate electronic elements subsequently.

As the vapor arising from evaporation of carrier-tape under high-temperature thermal sealing can penetrate into the base paper, not only corroding the electronic elements on the carrier-tape using such base paper, but also affecting the normal operation of the carrier-tape, and paper waterproof agent in the surface pulping material can effectively inhibit such penetration, common or market-available paper waterproof agent can be used, and the present invention prefers alkyl ketene dimer, rosin resin or tripalmitin alone or together.

The bonding agent accounting for 0.3-0.6% of the total surface pulping material is used for the present invention; bonding agent within this range can ensure appropriate bonding force; low bonding force may result in low viscosity that may incur peeling of covered tape when electronic elements on the carrier-tape using such base paper are removed; on the contrary, extremely high bonding force may result in bur or dust when the covered tape is stripped, which may incur contamination to the electronic elements or even damages to the paper layers.

It is applicable to select common bonding agents from aforesaid ones. The present invention prefers starch, modified starch, PVA, guar gum and carboxymethyl cellulose alone or together as the bonding agent.

Softening agent and thermal-fusion bonding agent are added to the intermediate pulping material of the present invention, so as to control the softness of intermediate layer at 100-150 mN and the paper powder generation measured with experimental method of taper friction loss (JIS L 1096 8.17.3) below 100 mg.

The present invention prefers silicon quarternium, polysiloxane and fatty acid alkyl ethoxylate alone or together as the softening agent; since the middle part of the carrier-tape bears principal deformation, the intermediate layer shall have certain softness to reduce physical damages to electronic elements; the softening agent amount should be controlled at 0.5-1.5% of the total pulping material for the intermediate layer; extremely low quantity may result in inadequate softness and physical damages to the electronic elements on the carrier-tape using the said base paper; whereas extremely high quantity will result in over high softness and may destabilize the abovementioned electronic elements.

To prevent contamination incurred by the dust to the electronic elements installed on the carrier-tape made of the base paper, thermal-fusion bonding agent shall be added to the intermediate pulping material, so as to eliminate dust produced by punching of the carrier-tape made of the said base paper. The present invention prefers polyester, polyurethane, polyvinyl alcohol, polystyrene and polyacrylate alone or together as the thermal-fusion bonding agent.

Crosslinking agent and bonding agent are added to the bottom pulping material for waterproof purpose, as the crosslinking agent may crosslink the hydroxyl in the bonding agent; the present invention prefers melamine, polyamide, biformyl and borax, alone or together as the crosslinking agent, while starch, modified starch, guar gum and carboxymethyl alone or together as the bonding agent, which can be either consistent or inconsistent with that used in the surface pulping material. The synergy of the crosslinking agent and bonding agent in the bottom pulping material will endow the bottom layer with certain waterproof resilience; stiffness of the bottom layer of the present invention is 25~40 mN.

To further disperse fibers in the pulp and remove insoluble impurities and foam, etc, thus obtaining uniform suspensoid, pulping materials for the surface, intermediate and bottom layers of the present invention have subjected to such treatments as screening, purification and degassing.

The present invention selects wire forming with multilayer papermaking method to obtain one or more surface, intermediate and bottom layers; as a preferred selection of the present invention, the surface and bottom layers are composed of 1-3 layers of synthetic paper respectively; whereas the intermediate layer comprises 3-7 layers of synthetic paper. According to multilayer papermaking method of the present invention, each layer of wet paper formed on the papermaking machine net is to be trans-printed to the felt for papermaking; it is applicable to use circular net multilayer papermaking machine, high-speed forming multilayer papermaking machine and so on.

In a preferred embodiment of the present invention, the said calendering steps are as follows: use a 100-110° C. hot roller to form a damp proof layer on the surface of the base paper. As pressed by the hot roller, some auxiliary materials inside the surface pulp fiber will flow out to form such layer. Further, before using the hot roller, spray water on the surface layer with a water injector at a working capacity of 1~2 g/m$^2$ to form a moisturized layer; water spray in extremely small quantity is inadequate to separate out the auxiliary materials in the surface layer to form a moisturized layer; whereas extremely large quantity will result in leaching of the auxiliary materials to the extent of making it difficult to form a moisturized layer and affecting the quality of the base paper. Water spray with water injector before pressing with hot roller is more favorable for soluble auxiliaries in the surface pulp fiber, such as sodium polyacrylate and starch, to form a moisturized layer on the surface of the base paper; a damp proof layer is to be formed through pressing with hot roller and evaporation, which can further improve the water resistance, strength and smoothness of the surface layer.

To ensure outstanding water tightness and bonding performance of the surface layer, and guard against shaking in case of tearing of the tape, 1-3% polyvinyl alcohol and 0.01-0.03% aluminum sulfate are to be added into the surface pulping materials during pulp conditioning according to a further preferred embodiment of the present invention.

To further improve the bonding force between the surface and intermediate layers, and minimize the dimensional variation of intermediate layer caused by weather conditions and storage to facilitate the removal of electronic elements, one or more surface layers formed with net are to be sprayed or coated with 0.5%-1% starch and 0.02-0.5% urea formaldehyde resin during papermaking according to a preferred embodiment of the present invention.

In a preferred embodiment of the present invention, the bottom layer formed with net is to be sprayed or coated with 0.5-1% anionic polyacrylamide and 0.02-0.5% starch during papermaking. This can further improve the bonding force between the intermediate and bottom layers, ensure that the interlayer bonding force measured with a Scott internal bonding strength tester is not less than 150 J/m$^2$, and further enhance the strength and resilience of the bottom layer.

In a preferred embodiment of the present invention, smoothness of the said surface and bottom layers is no less than 5 s.

The present invention can fabricate the base paper made thereby into punched or embossed carrier-tape; embossed carrier-tape is preferred.

In conclusion, the present invention can improve the quality of the carrier-tape base paper, and change the distribution of fibers in the base paper when compared to prior arts; different auxiliary materials are to be added into each layer as per demands for use of the carrier-tape; wet forming can realize integration of all layers; therefore, base paper of the present invention will not incur such adverse impacts as dust and mechanical damages to electronic elements on the carrier-tape using the base paper; furthermore, it can withstand paper treatment at varied strengths, such as bending, rolling and stripping; moreover, the surface is free of any bur; on this account, the base paper of the present invention is in accommodation with carrier-tape for electronic elements subjecting to higher requirements, which is worthy to be promoted.

SPECIFIC EMBODIMENTS

Further detailed description of the present invention in combination of embodiments is stated as follows. Particular embodiments are expected to explain the present invention other than restriction. Technicians in this field can make any modification to the embodiments after reading the Specifications; any modification within the coverage of Claims of the present invention is to be protected by the Patent Law.

Embodiment 1

A carrier-tape base paper making method comprises the following steps:

(1) Beating: Mix and break the pulping materials into surface, intermediate and bottom pulps prior to beating to the degree of 42 degrees SR (Schopper Riegler), 48 degrees SR and 38 degrees SR respectively; the surface pulping material comprises 45% sulfate softwood pulp and 55% sulfate hardwood pulp; the intermediate pulping material comprises 50% sulfate softwood pulp and 55% sulfate hardwood pulp; whereas the bottom pulping material comprises 40% sulfate softwood pulp and 60% sulfate hardwood pulp.

(2) Pulp conditioning: Adjust the concentration of well-beaten pulp to 0.65%, and add various auxiliary materials; wherein, weight of paper waterproof agent, paper strength agent and bonding agent added to the pulping materials for surface layer account for 1%, 3% and 0.3% of the total respectively; weight of softening agent and thermal-fusion bonding agent added to the pulping materials for intermediate layer account for 0.5% and 1% of the total respectively; weight of crosslinking agent and bonding agent added to the pulping materials for bottom layer account for 0.5% of the total respectively; after that, adjust the pH to 6.5 and stir the mixture evenly, then place it at 25 to 30 degrees C. for 20 minutes to obtain the papermaking materials for the surface, intermediate and bottom layers; finally, proceed with screening, purification and deslagging prior to degassing.

Aforesaid paper waterproof agent can be selected from at least one of alkyl ketene dimer, rosin resin and tripalmitin; the paper strength agent can be selected from at least one of polyacrylamide, sodium polyacrylate, chitin and polyaminoamide; the bonding agent can be selected from at least one of starch, modified starch, guar gum and carboxymethyl cellulose; the softening agent can be selected from at least one of silicon quarternium, polysiloxane and fatty acid alkyl ethoxylate; the thermal-fusion bonding agent can be selected from at least one of polyester, polyurethane, polyvinyl alcohol, polystyrene and polyacrylate; the crosslinking agent can be selected from at least one of melamine, polyamide, biformyl and borax.

(3) Papermaking: Proceed with wire forming with multilayer papermaking method to obtain one or more surface, intermediate and bottom layers; after that, proceed with bonding of wet paper in a sequence of surface-intermediate-bottom layers prior to pressing and drying with conventional method.

(4) Calendering and Rolling with Conventional Method

The carrier-tape base paper made with aforesaid method, comprising a rated 105 g/m$^2$ surface layer, a rated 200 g/m$^2$ intermediate layer and a rated 165 g/m$^2$ bottom layer; the tensile strength, surface strength expressed in critical wax strength grade and water resistance of the surface layer is 6.5 kN/m, 16 A and 600 s respectively; softness of the intermediate layer is 100 mN; paper powder generation measured with experimental method of taper friction loss is below 100 ppm; stiffness of the bottom layer is 25 mN; the interlayer bonding force measured with a Scott internal bonding strength tester is not less than 150 J/m$^2$.

Embodiment 2

A carrier-tape base paper making method comprises the following steps:

(1) Beating: Mix and break the pulping materials into surface, intermediate and bottom pulps prior to beating to the degree of 45 degrees SR, 50 degrees SR and 40 degrees SR respectively; the surface pulping material comprises 65% sulfate softwood pulp and 35% sulfate hardwood pulp; the intermediate pulping material comprises 30% sulfate softwood pulp and 70% sulfate hardwood pulp; whereas the bottom pulping material comprises 20% sulfate softwood pulp and 80% sulfate hardwood pulp.

(2) Pulp conditioning: Adjust the concentration of well-beaten pulp to 0.85%, and add various auxiliary materials; wherein, weight of paper waterproof agent, paper strength agent and bonding agent added to the pulping materials for surface layer account for 3%, 5% and 0.6% of the total respectively; weight of softening agent and thermal-fusion bonding agent as added to the pulping materials for intermediate layer account for 1.5% and 3% of the total respectively; weight of crosslinking agent and bonding agent as added to the pulping materials for bottom layer account for 1% of the total respectively; after that, adjust the pH to 7.5 and stir the mixture evenly, then place it at 25 to 30 degrees C. for 30 minutes to obtain the papermaking materials for the surface, intermediate and bottom layers; finally, proceed with screening, purification and deslagging prior to degassing.

(3) Papermaking: Proceed with wire forming with multi-layer papermaking method to obtain one or more surface, intermediate and bottom layers; after that, proceed with bonding of wet paper in a sequence of surface-intermediate-bottom layers prior to pressing and drying with conventional method.

(4) Use a water injector to spray water on the base paper at a working capacity of 1 g/m$^2$ and the speed of 1 m/min respectively to form a moisturized layer; after that, use a 100 to 110 degrees C. hot roller to proceed with hot pressing to form a damp proof layer on the surface of the base paper. Finally, carry out calendering and rolling with conventional method.

The carrier-tape base paper made with aforesaid method, comprising a rated 125 g/m$^2$ surface layer, a rated 500 g/m$^2$ intermediate layer and a rated 185 g/m$^2$ bottom layer; the tensile strength, surface strength expressed by critical wax strength grade and water resistance of the surface layer is 7.5 kN/m, 18 A and 650 s respectively; softness of the intermediate layer is 150 mN; paper powder generation measured with experimental method of taper friction loss is below 100 ppm; stiffness of the bottom layer is 40 mN; the interlayer bonding force measured with a Scott internal bonding strength tester is not less than 150 J/m$^2$; the smoothness of the surface and bottom layers is not less than 5 s.

Embodiment 3

A carrier-tape base paper making method comprises the following steps:

(1) Beating: Mix and break the pulping materials into surface, intermediate and bottom pulps prior to beating to the degree of 43 degrees SR, 49 degrees SR and 39 degrees SR respectively; the surface pulping material comprises 55% sulfate softwood pulp and 45% sulfate hardwood pulp; the intermediate pulping material comprises 40% sulfate softwood pulp and 60% sulfate hardwood pulp; whereas the bottom pulping material comprises 30% sulfate softwood pulp and 70% sulfate hardwood pulp.

(2) Pulp conditioning: Adjust the concentration of well-beaten pulp to 0.7%, and add various auxiliary materials; 2% rosin resin and tripalmitin (weight ratio between the two is 1:1), 4% sodium polyacrylate and chitin (weight ratio between the two is 2:1), 0.4% starch and guar gum (weight ratio between the two is 2:1), 1 to 3% polyvinyl alcohol and 0.01 to 0.03% aluminum sulfate are to be added to the surface pulping material; 1% polysiloxane and fatty acid alkyl ethoxylate (weight ratio between the two is 1:1), 2% polyurethane and poval (weight ratio between the two is 1:2) are to be added to the intermediate pulping material; 0.7% polyamide and biformyl (weight ratio between the two is 1.5:1) and 0.7% modified starch and carboxymethyl (weight ratio between the two is 2.5:1) are to be added to the bottom pulping material; after that, adjust the pH to 7.0 and stir the mixture evenly, then place it at 25 to 30 degrees C. for 25 minutes to obtain the papermaking materials for the surface, intermediate and bottom layers; finally, proceed with screening, purification and deslagging prior to degassing.

(3) Papermaking: One or more surface layers formed with net are to be sprayed or coated with 0.5% to 1% starch and 0.02 to 0.5% urea formaldehyde resin; the bottom layer formed with net is to be sprayed or coated with 0.5 to 1% anionic polyacrylamide and 0.02 to 0.5% starch during papermaking; after that, proceed with bonding of wet paper in a sequence of surface-intermediate-bottom layers; finally, proceed with pressing and drying with conventional method.

(4) Calendering and Rolling with Conventional Method

The carrier-tape base paper made with aforesaid method, comprising a rated 115 g/m$^2$ surface layer, a rated 250 g/m$^2$ intermediate layer and a rated 170 g/m$^2$ bottom layer; the tensile strength, surface strength expressed in critical wax strength grade and water resistance of the surface layer is 8.5 kN/m, 17 A and 620 s respectively; softness of the intermediate layer composed of 3-layer copy paper is 130 mN; paper powder generation measured with experimental method of taper friction loss is below 100 ppm; stiffness of the bottom layer composed of 1-layer copy paper is 30 mN; the interlayer bonding force measured with a Scott internal bonding strength tester is not less than 150 J/m$^2$;

Embodiment 4

Different from Embodiment 3, a water injector is used in Step (4) to spray water on the base paper running at the speed of 1.5 m/min and a working capacity of 2 g/m$^2$ to form a moisturized layer; after that, a 100 to 110 degrees C. hot roller is used to proceed with hot pressing to form a damp proof layer on the surface of the base paper. Finally, carry out calendering and rolling with conventional method.

The carrier-tape base paper made with aforesaid method, comprising a rated 125 g/m$^2$ surface layer, a rated 350 g/m$^2$ intermediate layer and a rated 185 g/m$^2$ bottom layer; the tensile strength, surface strength expressed in critical wax strength grade and water resistance of the surface layer is 8.8 kN/m, 17 A and 650 s respectively; softness of the intermediate layer composed of 7-layer copy paper is 130 mN; paper powder generation as measured with experimental method of taper friction loss is below 100 ppm; stiffness of the bottom layer composed of 1-layer copy paper is 30 mN; the interlayer bonding force measured with a Scott internal bonding strength tester is not less than 150 J/m$^2$; the smoothness of the surface and bottom layers is not less than 5 s.

Embodiment 5

Different from Embodiment 3, a water injector is used in Step (4) to spray water on the base paper running at the speed of 1.2 m/min and working capacity of 1.5 g/m$^2$ to form a moisturized layer; after that, a 100 to 110 degrees C. hot roller is used to proceed with hot pressing to form a damp proof layer on the surface of the base paper. Finally, carry out calendering and rolling with conventional method.

The carrier-tape base paper made with aforesaid method, comprising a rated 120 g/m$^2$ surface layer, a rated 320 g/m$^2$ intermediate layer and a rated 170 g/m$^2$ bottom layer; the tensile strength, surface strength expressed in critical wax strength grade and water resistance of the surface layer composed of 2-layer copy paper is 8.6 kN/m, 18 A and 650 s respectively; softness of the intermediate layer composed of 5-layer copy paper is 130 mN; paper powder generation as measured with experimental method of taper friction loss is below 100 ppm; stiffness of the bottom layer composed of 2-layer copy paper is 30 mN; the interlayer bonding force measured with a Scott internal bonding strength tester is not less than 150 J/m$^2$; the smoothness of the surface and bottom layers is not less than 5 s.

Different from Embodiment 3, the surface layer comprises 2-layer copy paper at the rated quantity of 115 g/m$^2$; the intermediate layer comprises 5-layer copy paper at the rated quantity of 500 g/m$^2$; whereas the bottom layer comprises 2-layer copy paper at the rated quantity of 170 g/m$^2$.

Physical indicators on the base paper made thereby by Embodiment 1 to 5 are listed in the following Table I:

TABLE I

| | Indicators | | | | | |
|---|---|---|---|---|---|---|
| Embodiment | Surface tensile strength (kN/m) | Surface strength (A) | Interlayer bonding force (J/m$^2$) | Paper powder generation (ppm) | Water resistance (s) | Smoothness (s) |
| 1 | 6.5 | 16 | 153 | 100 | 600 | 5 |
| 2 | 7.5 | 18 | 155 | 95 | 650 | 6 |
| 3 | 8.5 | 17 | 165 | 80 | 620 | 6 |
| 4 | 8.8 | 17 | 166 | 85 | 650 | 6 |
| 5 | 8.6 | 18 | 165 | 80 | 650 | 6 |

Any part not mentioned in the present invention belongs to the art commanded by technicians in this field.

What is claimed is:

1. A method of making a carrier-tape base paper, the paper having surface, intermediate and bottom layers formed through papermaking, the method comprising:

(1) a beating step comprising mixing and breaking pulping materials for surface, intermediate and bottom layers into surface, intermediate and bottom pulps prior to beating to the degree of 42 to 45 degrees SR, 48 to 50 degrees SR and 38 to 40 degrees SR respectively;

(2) a pulp conditioning step comprising adjusting the concentration of well-beaten pulp to between 0.65% and 0.85% and adding various auxiliary materials; wherein weights of paper waterproof agent, paper strength agent and bonding agent are added to the pulping materials for the surface layer to account for between 1% to 3%, between 3% to 5% and between 0.3% to 0.6% of the total respectively, wherein weights of softening agent and thermal-fusion bonding agent as added to the pulping materials for the intermediate layer account for between 0.5% to 1.5% and between 1% to 3% of the total respectively, and wherein weights of crosslinking agent and bonding agent as added to the pulping materials for the bottom layer account for between 0.5% to 1% of the total respectively, and subsequently, adjusting the pH to between 6.5 to 7.5 and stir the mixture evenly, then place it at between 25 degrees C. and 30 degrees C. for 30 minute to obtain the papermaking materials for the surface, intermediate and bottom layers; finally, proceed with screening, purification and deslagging prior to degassing;

(3) a papermaking step comprising:

proceeding with wire forming with multi-layer papermaking to obtain one or more surface, intermediate and bottom layers, and subsequently proceeding with bonding of wet paper in a sequence from surface-intermediate-bottom layers prior to pressing and drying; and (4) polishing and rolling, wherein:

the pulping material for the surface layer in the beating step comprises between 45% and 65% sulfate softwood pulp and between 35% and 55% sulfate hardwood pulp;

the pulping material for the intermediate layer comprises between 30% and 50% sulfate softwood pulp and between 55% and 75% sulfate hardwood pulp; and the pulping material for the bottom comprises between 20% and 40% sulfate softwood pulp and between 65% and 80% sulfate hardwood pulp.

2. A method according to claim 1 wherein:

the paper waterproof agent is selected from at least one of alkyl ketene dimer, rosin resin and tripalmitin;

the paper strength agent is selected from at least one of polyacrylamide, sodium polyacrylate, chitin and polyaminoamide;

the bonding agent is selected from at least one of starch, modified starch, guar gum and carboxymethyl cellulose;

the softening agent is selected from at least one of silicon quarternium, polysiloxane and fatty acid alkyl ethoxylate;

the thermal-fusion bonding agent is selected from at least one of polyester, polyurethane, polyvinyl alcohol, polystyrene and polyacrylate; and the crosslinking agent is selected from at least one of melamine, polyamide, biformyl and borax.

3. A method according to claim 1, wherein the step of the polishing and rolling comprises using a hot roller between 100 and 100 degrees C. to form a damp proof layer on a surface of the base paper.

4. A method according to claim 3, wherein a water injector is used to spray water on the surface layer at a working capacity of between 1 and 2 g/m$^2$ before pressing with a hot roller to form a moisturized layer.

5. A method according to claim 1, wherein between 1% and 3% polyvinyl alcohol and between 0.01% and 0.03% aluminum sulfate are added to the pulping material for the surface layer during the step of pulp conditioning.

6. A method according to claim 1, wherein at least one surface layer formed with net is coated with between 0.5% and 1% starch and between 0.02% and 0.5% urea formaldehyde resin during papermaking.

7. A method according to claim 1, wherein one or more bottom layers as formed with net is sprayed or coated with between 0.5% and 1% anionic polyacrylamide and between 0.02% and 0.5% starch during papermaking.

8. A carrier-tape base paper having surface, intermediate and bottom layers formed through papermaking, the carrier-tape base paper made by a method comprising:

(1) a beating step comprising mixing and breaking pulping materials for surface, intermediate and bottom layers into surface, intermediate and bottom pulps prior to beating to the degree of between 42 and 45 degrees SR, between 48 and 50 degrees SR and between 38 and 40 degrees SR respectively;

(2) a pulp conditioning step comprising adjusting the concentration of well-beaten pulp to between 0.65% and 0.85% and adding various auxiliary materials; wherein weights of paper waterproof agent, paper strength agent and bonding agent are added to the pulping materials for the surface layer to account for between 1% and 3%, between 3% and 5% and between 0.3% and 0.6% of the total respectively, wherein weights of softening agent and thermal-fusion bonding agent as added to the pulping materials for the intermediate layer account for between 0.5% and 1.5% and between 1% and 3% of the total respectively, and wherein weights of crosslinking agent and bonding agent as added to the pulping materials for the bottom layer account for between 0.5% and 1% of the total respectively, and subsequently, adjusting the pH to between 6.5 and 7.5 and stir the mixture evenly, then place it at between 25 degrees C. and 30 degrees C. for 30 minutes to obtain the papermaking materials for the surface, intermediate and bottom layers; finally, proceed with screening, purification and deslagging prior to degassing;

(3) a papermaking step comprising:

proceeding with wire forming with multi-layer papermaking to obtain one or more surface, intermediate and bottom layers, and subsequently proceeding with bonding of wet paper in a sequence from surface-intermediate-bottom layers prior to pressing and drying; and (4) polishing and rolling, wherein:

the pulping material for the surface layer in the beating step comprises between 45% and 65% sulfate softwood pulp and between 35% and 55% sulfate hardwood pulp;

the pulping material for the intermediate layer comprises between 30% and 50% sulfate softwood pulp and between 55% and 75% sulfate hardwood pulp; and the pulping material for the bottom comprises between 20% and 40% sulfate softwood pulp and between 65% and 80% sulfate hardwood pulp, wherein the carrier-tape base paper comprises a rated 105 to 125 g/m$^2$ surface layer, a rated 200 to 500 g/m$^2$ intermediate layer, and a rated 165 to 185 g/m$^2$ bottom layer;

wherein, according to the performance requirements of each layer, different paper pulp raw materials are employed for the surface layer, intermediate layer and bottom layer, and different auxiliary materials are added for conditioning the pulp and making the paper;

wherein the tensile strength, surface strength expressed in critical wax strength grade and water resistance of the surface layer is 6.5 to 8.5 kN/m, 16 A to 18 A and not less than 600 s respectively;

wherein the softness of the intermediate layer is 100 and 150 mN;

wherein paper powder generation measured with an experimental method of taper friction loss is below 100 ppm;

wherein stiffness of the bottom layer is between 25 and 40 mN; and wherein the interlayer bonding strength measured with a Scott internal bonding strength tester is not less than 150 J/m$^2$.

9. A carrier-tape base paper according to claim 8, wherein the intermediate layer comprises 3-7 layers of copy paper, and the surface and bottom layers comprise 1 to 3 layers of copy paper.

10. A carrier-tape base paper according to claim 8, wherein the smoothness of the surface and bottom layers is not less than 5 s.

* * * * *